United States Patent [19]

Dundas et al.

[11] Patent Number: 4,527,708

[45] Date of Patent: Jul. 9, 1985

[54] LIQUID TANK SPILLAGE CONTROL SYSTEM

[75] Inventors: Richard E. Dundas, Rockford; Gerald H. Visser, Grand Rapids, both of Mich.

[73] Assignee: Plymouth Tank of West Michigan, Inc., Grand Rapids, Mich.

[21] Appl. No.: 610,265

[22] Filed: May 14, 1984

[51] Int. Cl.[3] ..... B65D 25/00

[52] U.S. Cl. ..... 220/18; 220/1 B; 220/85 P; 220/85 S; 220/85 F

[58] Field of Search ..... 220/18, 85 S, 85 P, 220/85 F, 1 B

[56] References Cited

U.S. PATENT DOCUMENTS

| | | | |
|---|---|---|---|
| 1,157,675 | 10/1915 | Caskey | 220/18 |
| 2,217,580 | 10/1940 | White | 220/85 S |
| 2,327,628 | 8/1943 | Ewing | 220/85 S |
| 2,382,171 | 8/1945 | Pomykala | 220/18 X |
| 2,757,045 | 7/1956 | Nullet | 220/18 X |

FOREIGN PATENT DOCUMENTS

| | | | |
|---|---|---|---|
| 173231 | 2/1935 | Switzerland | 220/18 |

*Primary Examiner*—Steven M. Pollard

*Attorney, Agent, or Firm*—Price, Heneveld, Huizenga & Cooper

[57] ABSTRACT

A spill control device for underground liquid storage tanks having an upwardly extending fill pipe. The control device comprises a steel, epoxy coated, liquid collecting spill tank having a riser tube that extends upward through the tank bottom. A circular seal ring fits about the upper end of the riser tube and about the outer wall of a fill pipe received through the riser tube. A clamp compresses the seal about both the riser tube and fill pipe.

21 Claims, 5 Drawing Figures

LIQUID TANK SPILLAGE CONTROL SYSTEM

BACKGROUND OF THE INVENTION

The present invention relates to systems for underground liquid storage tanks to control spillage during filling of the tank, and in particular to spillage containment vessels for use with such underground tanks.

Underground storage tanks used in the storage of toxic or flammable liquids, such as those used for storage of petroleum products at service stations and the like, normally include a casing or fill pipe that runs from the subsurface tank up to the ground surface. A manhole surrounds the upper end of the casing in order to access the casing and provide clearance for a valve used to connect delivery truck fill hoses to the casing. Although most liquid product delivery trucks are equipped with a shut-off valve that stops liquid flow to the fill hose when a storage tank is full, spillage of product is common when filling such tanks. Spills normally occur due to leakage at the fill pipe-hose coupling or by the discharge of the standing liquid within the truck hose. Even though the truck's shut-off valve halts delivery to the base, the truck hose remain filled with liquid product. When the hose is disconnected from the casing, this remaining liquid runs out onto the ground.

The contamination produced by such liquid storage tank spills results in a substantial health hazard. When toxic or flammable liquids, such as gasoline, diesel fuel or the like are dumped onto the ground, these products may enter the local ground water or otherwise enter into the ecosystem. Even if the spillage is not absorbed into the ground but is drained off into a sewage system, a toxic or explosive atmosphere can be produced within the local sewer system.

The severity of contamination due to underground liquid storage tank spillage is evidenced by the fact that various state and local governments are enacting legislation to require systems for controlling such spills. Although various methods may be utilized on tanks installed in the future, the problem remains with the numerous previously installed underground storage tanks presently in use.

SUMMARY OF THE INVENTION

The present invention solves the problems associated with product spillage during the filing of underground liquid storage tanks by the provision of a liquid impermeable containment vessel that is located at the top of the tank fill pipe. The fill pipe extends up through the bottom of the containment vessel, and the bottom of the vessel is sealed about the fill pipe in order to prevent the passage of liquid product therethrough. Since the containment vessel is situated about the upper end of the storage tank fill pipe, any leakage about the fill hose-pipe coupling or back flow from the fill hose will be captured within the containment vessel. The liquid product is thus prevented from being dumped onto the ground or entering into a local sewer system.

According to another aspect of the invention, the liquid containment vessel is provided with an internal riser tube and a coupling that seals the riser tube to a liquid storage tank fill pipe. Preferably, this coupling includes a removable seal that extends about both the riser tube and fill pipe and a clamp element that clamps the seal between the fill pipe and the tank.

These and other aspects or features of the invention will be apparent to one skilled in the art from the specification, claims and drawings appended hereto.

DETAILED DESCRIPTION OF THE PREFERRED EMBODIMENTS

Figure 1:
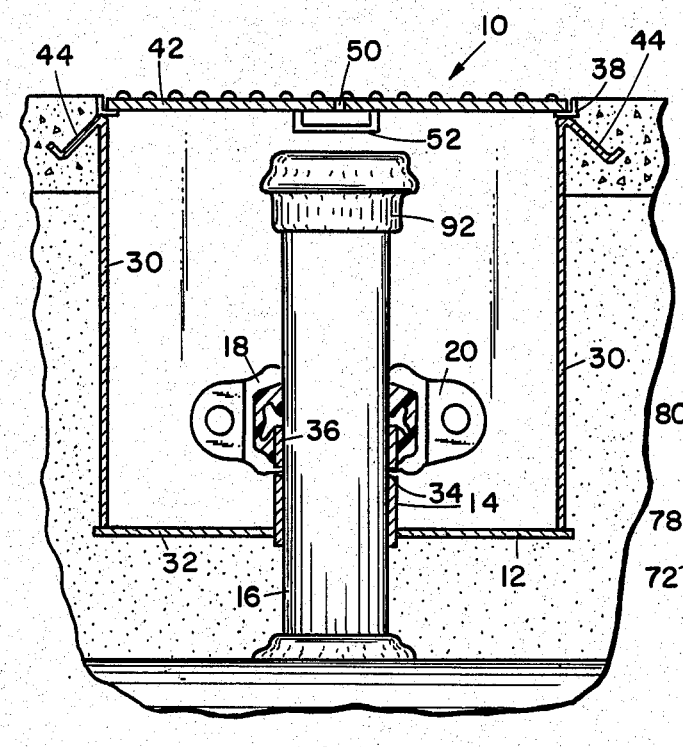
FIG. 1 is a front elevational, sectional view of a spill control device embodying the present invention installed upon the fill pipe of an underground liquid storage tank, with only a portion of the tank being shown.
Figure 2:
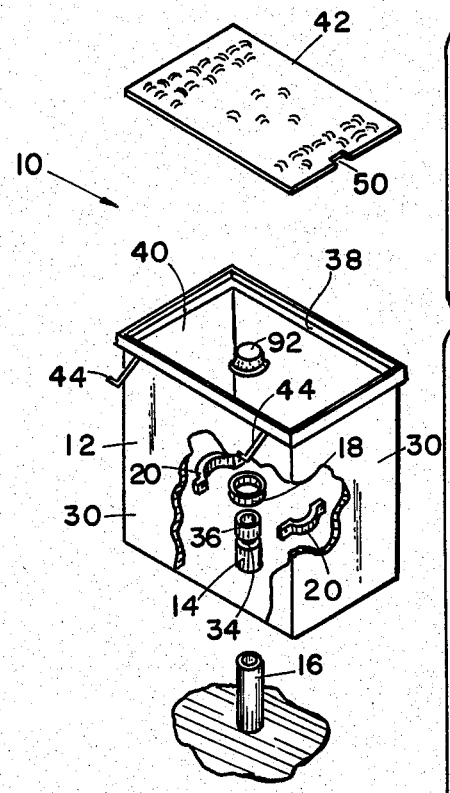
FIG. 2 is an exploded, perspective view of the spill control device shown in FIG. 1, with a portion of the containment vessel partially broken away.

A spill control system or device for underground liquid storage tanks is illustrated in FIGS. 1 and 2 and designated generally by the reference number 10. Spill control device 10 includes a containment tank or basin 12 that has a short, cylindrical riser tube 14 that is mounted on the bottom of tank 12. A conventional liquid storage tank fill pipe 16 is received through riser tube 14 so that tank 12 is buried flush with the ground surface. A seal ring 18 encircles the joint between riser tube 14 and fill pipe 16 while a pair of clamp brackets 20 clamp about both riser tube 14 and fill pipe 16 in order to compress seal 18 in place. Containment tank 12 operates to capture any liquid that is spilled during the filling of the storage tank.

As illustrated herein, containment tank 12 is a vessel formed by four sidewalls 30 that are welded or otherwise suitably joined to a bottom 32 to form a rectangular box. Riser tube 14 passes upward through bottom 32 and is welded thereto. Spaced slightly beneath the top edge of riser tube 14 is an annular channel or groove 34 that extends in a ring about the outer surface of riser tube 14. Channel 34 forms a seat for clamp brackets 20 and also defines a seal contact surface 36 above channel 34. Extending continuously about the upper perimeter on top of sidewalls 30 is a right angle flange or L-shaped seating bracket 38 that defines a rectangular access opening 40 (FIG. 2) through the top of tank 12. Seating bracket 38 is used to seat a cover or closure member 42 in access opening 40. Depending at an outwardly, downwardly sloping angle from bracket 38 are four "L"-shaped pavement anchors 44. Anchors 44 are used to anchor tank 12 within the pavement or ground surface with bracket 38 flush therewith, so that frost or ground movement will not raise tank 12 above the surrounding pavement.

Preferably tank 10 is made of steel sheet ten gauge thick. Tank bottom 32 is a rectangular shape sixteen inches wide by eighteen inches long. Sidewalls 30 with seat bracket 38 are eighteen and one-half inches high, while riser tube 14 extends three inches above bottom 32. Tank 12 therefore has a capacity of over twenty gallons. Riser tube 14 has an inside diameter that is determined by the outside diameter of the particular fill pipe 16 device 10 is to be used with. Although riser tube 14 closely receives pipe 16 in order to permit seal 18 to bridge the joint between tube 14 and pipe 16, riser tube 14 provides enough clearance to accommodate some misalignment of pipe 16.

Tank 12 and riser tube 14, are coated on both the interior and exterior with an epoxy coating to prevent corrosion of tank 12. A suitable epoxy coating is one sold by Koppers Company Inc. under the trade designation Bitumastic 300M Coal Tar Epoxy. Alternatively, tank 12 may be made from stainless steel, fiberglass or other corrosion resistant materials.

Alternatively, tank 12 may be cylindrically shaped rather than a rectangular box. In the alternative cylindrical embodiment, bottom 32 is preferably eighteen inches in diameter while sidewalls 30 are eighteen inches high. Seat bracket 38 increases the height of sidewalls 30 by one-half inch to give tank 12 an overall height of eighteen and one-half inch.

Cover 42 is a flat rectangular plate dimensioned to fit within seat bracket 38. Cover 42 includes raised lugs on its upper surface to provide a conventional traction surface. Cover 42 is normally three-eights of an inch thick so that cover 42 will seat beneath the upper edge of seat bracket 38. Since cover 42 is recessed, objects will not strike or catch and inadvertently lift cover 42. A rectangular notch 50 is cut on one side of the cover 42 to provide a removal aperture in which a tool can be inserted in order to lift the cover. Depending from the underside of cover 42 adjacent notch 50 is a bent metal handle 52. Handle 52 is used to pick up cover 42 once it has been raised using notch 50.

Figure 4:
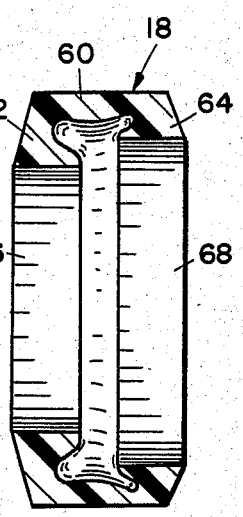
FIG. 4 is a sectional view of the seal element used with the clamp element shown in FIG. 3, the seal element being turned on its side.

Seal 18 shown in FIG. 4 is a generally circular ring having an outer wall 60. An upper flange 62 and a lower flange 64 extend radially inward from outer wall 60 and define an upper aperture 66 and a lower aperture 68 respectively. Upper flange 62 extends inward further than lower flange 64 so that upper aperture 66 has a diameter smaller than that of lower aperture 68. Lower aperture 68 is provided with a diameter which creates a snug fit about riser tube 14 on seal contact surface 36. Similarly, upper aperture 66 has a diameter which provides a snug fit about fill pipe 16 just above the top of edge of riser tube 14. Seal wall 60 is therefore tall enough to span the gap between riser tube 14 and fill pipe 16, while the different diameters of upper and lower apertures 66, 68 provide a tight seal simultaneously about the different diameters of riser tube 14 and fill pipe 16. The inner free edge of both upper flange 62 and lower flange 64 widen out to form enlarged vertical sealing surfaces that are deformable to provide a tight seal about the entire tube or pipe circumference. Preferably, seal 18 is formed from a rubber or polymeric material that is unaffected by petroleum products. Most preferably seal 18 is made from a Buna N rubber material so that gasoline or other petroleum products will not deteriorate the seal.

Figure 3:
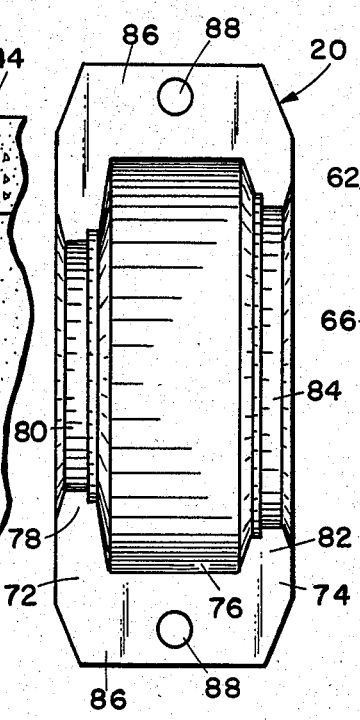
FIG. 3 is a front elevational view of a clamp section used in the spill control device of FIG. 1, the clamp section being turned on its side.
Figure 5:
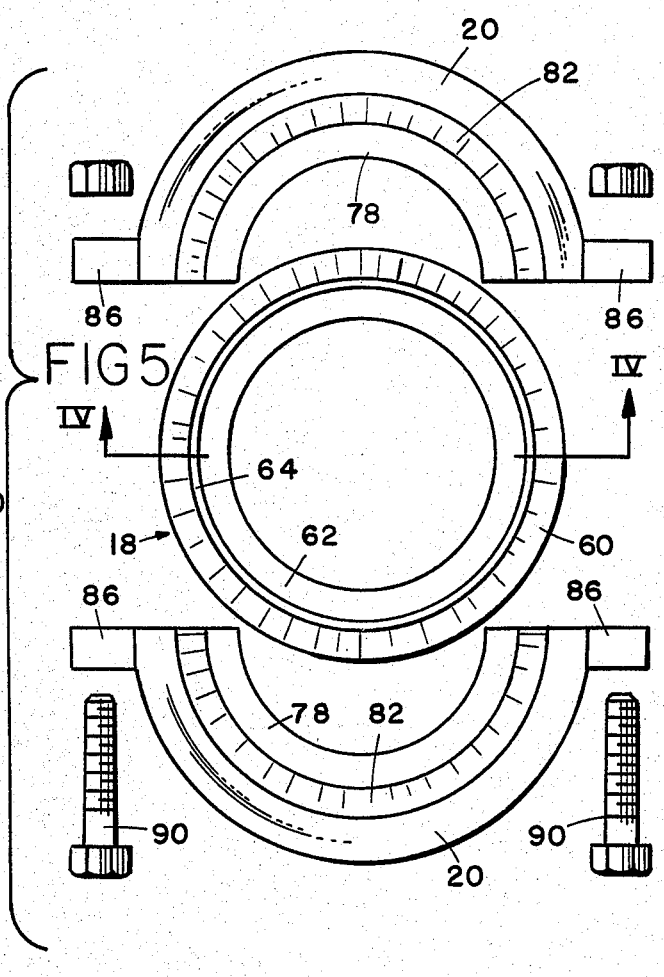
FIG. 5 is a bottom plan view of two clamp elements as shown in FIG. 3 and the seal element of FIG. 4, shown with the clamp elements in a unclamped condition.

As shown in FIG. 3, each clamp bracket 20 is provided with a semi-circular or "C"-shape which extends around half of seal 18. Each clamp bracket has an upper flange 72 and a lower flange 74 that extend radially inward to define a seal seat area 76 therebetween. Seal seat area 76 is a generally trapezoidal shaped recess within which the seal sidewall 60 is disposed with a snug fit. Extending inward from upper flange 72 is an upper clamp lip 78 that forms an upper aperture 80 when two clamp halves 20 are joined together. Similarly, the inner free end of lower flange 74 has an inwardly exending lower clamp lip 82 that defines a lower aperture 84 when two clamp brackets 20 are joined together. The radius of lower clamp aperture 84 is approximately equal to the inner radius of riser tube channel 34. Lower clamp lip 82 will therefore seat solidly within channel 34 when two clamp brackets 20 are joined together about channel 34. Similarly, the radius of upper aperture 80 is approximately equal to the outer radius of fill pipe 16 so that upper lip 78 will seat solidly against the outer wall of fill pipe 16. When seal 18 is seated in seat area 76 clamp upper flange 72 and lower flange 74 extend inward less than seal upper flange 62 and lower flange 64 respectively. Seal upper flange 62 and lower flange 64 therefore protrude into the apertures formed between clamp brackets 20. This protrusion of upper and lower flanges 62, 64 provide for compression of seal 18 about the riser 14 and the fill pipe 16. Extending radially outward from either side of bracket 20 is a flat connecting flange or ear 86 having a bolt aperture 88 therethrough. A pair of bolts 90, FIG. 5, pass through apertures 88 and secure clamp brackets 20 together.

Fill pipe 16 is a conventional fill pipe for an underground liquid storage tank. Fill pipe 16 extends upward from the tank and terminates a short distance beneath the ground surface. A threaded cap 92 is used to close pipe 16 when the storage tank is not being filled.

ASSEMBLY

In order to assemble spill control device 10, the ground surrounding the upper end of fill pipe 16 is excavated and any conventional manholes or the like are removed. Tank 12 is fitted down over fill pipe 16, with fill pipe 16 being readily received up through riser tube 14. When seat bracket 38 is located flush with the surrounding ground, surface tank 12 is clamped to fill pipe 16. Seal 18 is fitted over the upper end of riser tube 16 and slid downwardly until lower seal flange 64 is received over riser tube 14 and seated on contact surface 36. A suitable lubricant may be used in order to assist in sliding seal 18 down riser tube 16. Clamp brackets 20 are then fitted about seal 18, with seal 18 being received in seat area 76. Bolts 90 are tightened in connecting flanges 86 in order to compress seal 18 about the joint between riser tube 14 and fill pipe 16. When fully tightened, lower clamp lip 82 is solidly seated in riser tube channel 34 and upper clamp lip 78 contacts riser tube 16. Riser tube 14 accommodates small deviations of fill pipe 16 from the vertical due to its inner diameter being greater than that of fill pipe 16. Once clamped in position, the excess excavation is filled in and pavement is patched around tank 12. Anchors 44 are set in the surrounding pavement and insure that tank 12 remains flush with the ground surface.

It is to be understood that the above is merely a description of the preferred embodiments. It will be apparent to one skilled in the art that various modifications or improvements may be made without departing from the spirit of the invention disclosed herein. The scope of the protection afforded is to be determined by the claims which follows and the breadth of interpretation which the law allows.

The embodiments of the invention in which an exclusive property or privilege is claimed are as follows:

1. A spill control device for underground liquid storage tanks used in the storage of toxic or flammable materials, comprising:

a liquid impermeable spill collecting tank having a top and a bottom, said top having an access opening thereat that provides sufficient clearance for the passage of a fill hose therethrough, said tank having a pipe aperture through said bottom of a dimension sufficient to provide the close reception of a liquid storage tank fill pipe therethrough; and means for sealing said tank bottom about a liquid storage tank fill pipe received through said pipe aperture to prevent fluid passage through said pipe aperture, whereby said tank forms a liquid impermeable container about the upper end of a liquid storage tank fill pipe when assembled thereon to prevent liquid contaminants from entering the ground surrounding said pipe.

2. The spill control device of claim 1, wherein:

said sealing means includes a seal element having an inner seal area for receipt of a fill pipe therethrough; and means for clamping said seal to a fill pipe received through said access opening and for clamping said seal to said tank.

3. The spill control device of claim 2, further comprising:

a containment pipe extending upwardly from said tank bottom and communicative therethrough, said clamping means clamping said seal element to said containment pipe.

4. The spill control device of claim 3, wherein:

said clamp means has an upper lip defining an upper opening and a lower lip defining a lower opening larger than said upper opening, said lower lip extending about said containment pipe and said upper lip disposed to extend about a fill pipe received through said containment pipe.

5. The spill control device of claim 4, wherein:

said containment pipe includes a clamp channel extending about its upper end, said clamping means lower lip being seated in said clamp channel.

6. The spill control device of claim 5, wherein:

said clamp channel is spaced beneath the top edge of said containment pipe and defines a seal seating surface between said clamp channel and said fill pipe top edge.

7. The spill control device of claim 6, wherein:

said seal element is a ring having an upper flange defining an upper seal aperture and a lower flange defining a lower seal aperture larger than said upper seal aperture, said lower seal flange extending about said containment pipe and said upper seal flange disposed to extend about a fill pipe received through said containment pipe.

8. The spill control device of claim 3, wherein:

said seal element is a continuous ring having an upper flange defining an upper seal aperture and a lower flange defining a lower seal aperture larger than said upper seal aperture, said lower seal flange extending about said containment pipe and said upper seal flange disposed to extent about a fill pipe received through said containment pipe.

9. The spill control device of claim 8, wherein:

said clamping means including a seal seat recess, said seal element being received in said seal seat recess so as to be encased by said clamping means when clamped to said containment pipe.

10. The spill control device of claim 1, wherein:

said tank is coated with an epoxy material.

11. A spill control device for underground liquid storage tanks used in the storage of toxic or flammable materials, comprising:

a liquid impermeable containment vessel having an upper opening, a bottom surface and a riser tube extending upwardly from said bottom surface, said riser tube having an inner diameter sufficient to receive a liquid storage tank fill pipe therethrough; and a liquid impermeable coupling having means for connecting said riser tube to a fill pipe received through said riser tube and for preventing the passage of liquid between said riser tube and said fill pipe.

12. The spill control device of claim 11, wherein:

said coupling has an upper aperture and a lower aperture larger in diameter than said upper aperture and communicative therewith, said lower aperture dimensioned to sealably receive said riser tube therein, said upper aperture dimensioned to sealably receive a storage tank fill pipe therein.

13. The spill control device of claim 12, wherein:

said coupling includes a separable seal ring, said seal ring having an upper seal flange defining said upper aperture and a lower seal flange defining said lower aperture.

14. The spill control device of claim 13, wherein:

said riser tube includes a seating channel extending about the outer perimeter of said riser tube, said coupling being seated in said seating channel.

15. The spill control device of claim 14, wherein:

said coupling includes a pair of selectively joinable clamp brackets that extend around said seal ring and seat in said seating channel.

16. The spill device of claim 15, wherein said containment vessel includes a corrosion resistant epoxy coating.

17. A kit for assembling a spill control device for underground liquid storage tanks used in the storage of toxic or flammable materials, comprising:

a liquid collecting spill tank having sides and a bottom, said tank having a riser tube extending upwardly from said bottom, said riser tube having an aperture therethrough dimensioned to receive a liquid storage tank fill pipe therein;

a circular seal element dimensioned to be received over and seal against the upper end of said riser tube, said seal element having an inner sealing surface to contact and seal against a liquid storage tank fill pipe received through said riser tube;

a clamp having a seal seat dimensioned to receive said seal element therein and having a lower end dimensioned to clamp said seal to said riser tube, said clamp having an upper end dimensioned to clamp said seal to a fill pipe received through said seat, whereby said tank, seal element and clamp may be assembled onto a liquid storage tank fill pipe in order to provide a liquid impermeable containment vessel about the upper end of said riser tube.

18. The kit of claim 17, wherein:

said seal element has an upper flange defining an upper seal aperture and a lower flange defining a lower seal aperture larger than said upper seal aperture, said lower seal aperture dimensioned to seal said lower flange around said riser tube and said upper aperture dimensioned to seal and upper flange around said fill pipe.

19. The kit of claim 18, wherein:

said clamp has an upper lip defining an upper opening and a lower lip defining a lower opening larger than said upper opening, said lower lip dimensioned to extend about said riser tube and said upper lip dimensioned to extend about a fill pipe received through said riser tube.

20. The kit of claim 19, wherein:

said riser tube includes an annular recess in the outer surface thereof for reception of said clamp lower lip, said annular recess spaced beneath the upper edge of said riser tube to define a seal seating zone above said annular recess.

21. The kit of claim 20, wherein:

said spill tank is coated with a corrosion resistant epoxy material.

* * * * *